US005372277A

United States Patent [19]

Waring

[11] Patent Number: 5,372,277

[45] Date of Patent: Dec. 13, 1994

[54] BALL DISPENSING UNIT

[75] Inventor: Christopher J. Waring, New Haw, United Kingdom

[73] Assignee: Blo-Tech Limited, Weybridge, England

[21] Appl. No.: 3,526

[22] Filed: Jan. 12, 1993

[30] Foreign Application Priority Data

Jan. 13, 1992 [GB] United Kingdom ..... 9200628

[51] Int. Cl.[5] ..... B65G 59/00

[52] U.S. Cl. ..... 221/68; 273/201; 406/181

[58] Field of Search ..... 221/278, 301, 311, 68, 221/107, 108, 175, 176; 406/181; 414/798.8, 798.2; 273/201; 198/442; 193/14, 29

[56] References Cited

U.S. PATENT DOCUMENTS

| | | | |
|---|---|---|---|
| 789,049 | 5/1905 | Middleton | 406/181 |
| 1,913,675 | 6/1933 | Kerr | 406/181 |
| 3,376,897 | 4/1968 | Dolder et al. | 406/181 |
| 3,410,453 | 11/1968 | Lawrence | 221/175 |
| 3,544,170 | 12/1970 | Bowles | 406/181 |
| 4,308,944 | 1/1982 | Probst | 198/442 |
| 4,705,176 | 11/1987 | Oden | 221/176 |
| 5,033,642 | 7/1991 | Hooghiemstra | 273/201 |

FOREIGN PATENT DOCUMENTS

| | | | |
|---|---|---|---|
| 659358 | 4/1979 | U.S.S.R. | 221/68 |

*Primary Examiner*—Kenneth W. Noland

*Attorney, Agent, or Firm*—Dennison, Meserole, Pollack & Scheiner

[57] ABSTRACT

A dispensing unit for separating balls from a supply stream, particularly for use on golf driving ranges, comprises a supply tube (10) and a delivery tube which has a header tube (12) with a mouth portion (16) leading from the supply tube (10), and the supply tube (10) is provided with deflector ramp (14) inclined towards the mouth (16) of the header tube (12) but stopping short thereof so as not to prevent the onward passage of balls through the supply tube, whereby balls passing along the supply tube (10) are deflected into the mouth (16) to fill the header tube (12) and when the header tube (12) is full continue to pass through the supply tube (10). A typical installation includes a trunk supply tube leading to several of the dispensing units in series. When the header at the first unit in the series is full further balls pass on to the next unit until its header is full and so on until all headers in the system are full.

17 Claims, 2 Drawing Sheets

BALL DISPENSING UNIT

This invention relates to a dispensing unit for balls. It is particularly concerned with a system for separating balls at a given station from a stream of balls, for example golf balls at a bay on a golf driving range, or for tennis balls or at an industrial work station, and dispensing the balls at the required point of use. The invention is primarily described herein with regard to the golf driving range application.

Increasing interest in golf and the relative scarcity and expense of conventional golf courses has led to the rapid growth of golf driving ranges. Such ranges typically include a large number of individual bays from which a golfer drives a large number of balls in a short period of time. The recovery and re-use of the huge number of balls represents a major logistical problem for the range operator.

According to the invention there is provided a dispensing unit for balls which comprises a supply tube (10) and a delivery tube, characterised in that the delivery tube comprises a header tube (12) with a mouth portion (16) leading from the supply tube (10), and the supply tube (10) is provided with deflector means (14) inclined towards the mouth (16) of the header tube (12) but stopping short thereof so as not to prevent the onward passage of balls through the supply tube, whereby balls passing along the supply tube (10) are deflected into the mouth (16) to fill the header tube (12) and when the header tube (12) is full continue to pass through the supply tube (10).

The units according to the invention are primarily intended for use in applications requiring delivery of balls at more than one point and thus a typical installation includes a trunk supply tube leading to several units in series. When the header at the first unit in the series is full further balls pass on to the next unit until its header is full and so on until all headers in the system are full. As balls are withdrawn from each individual unit they are immediately replaced by new incoming balls from the supply tube.

The balls roll along the base of the supply tube until they are deflected towards the header tube. They are typically propelled by pneumatic pressure, usually within supply tubes which are substantially horizontal, although certain applications may permit an inclined arrangement of the main supply tube wherein the balls are moved by gravity without pneumatic assistance. The configuration of deflector means and other tube components and any supporting pneumatic pressure is such that the balls cross the gap between the ramp and the header and thus enter the mouth of the header. When the header tube is full to the extent that it can receive no more balls, the next balls arriving at its mouth pass back into the supply tube, through the gap between the deflector means and the header mouth and resume their rolling movement along the supply tube under the either pneumatic pressure therein or under gravity or kinetic energy.

Any pneumatic system, of hoppers, blowers, venturis etc., employed for moving the balls through the respective tubes can be of a conventional type and is not described in detail herein.

In the most convenient operating arrangement for golf driving bays a dispensing unit according to the invention is provided in each individual bay so that an exclusive supply of balls is separated and dispensed immediately adjacent to each golfer. A trunk supply tube leads in turn to a dispensing unit in each next bay. A system employing multiple dispensing units according to the invention in this manner offers the advantage of delivering a regular supply of balls to each individual driving bay and can be operated so as to ensure that a supply of balls is always available at each individual bay. From the viewpoint of the range operator this ensures that maximum use can be made of each individual bay.

In its application to golf driving ranges a unit according to the invention is intended for use in a system whereby a large hopper is regularly refilled by balls recovered from the range. The balls are then fed from the hopper into a main supply tube in which they are conveyed to the required points of use.

The dispensing unit of the invention can be used in combination with a controlled release unit at the downstream end of the delivery tube. The golfer can then withdraw balls from the release unit as required. The release unit can incorporate a payment system, operated for example by cash or by a "smart card" arrangement which counts the number of balls used and automatically debits the golfer's account.

The header tube is preferably a curved tube extending from the supply tube to a downpipe leading to a dispensing point. Such a downpipe offers the advantage of permitting gravity feed of the balls therefrom. Its mouth portion can be connected to the wall of the supply tube at any convenient point, for example in the upper part or in the sidewall thereof. The upstream part of the header tube (upstream with respect to the flow of balls and any pneumatic gas flow) preferably presents a contoured slope towards the flow of balls, thereby acting both to reduce any tendency for balls to rebound back out of the header tube when it is nearly full, and also to assist any "overfill" balls to roll back into the supply tube and continue along it when the header tube is full.

The respective tubes are preferably of circular cross section although non-circular cross sections, e.g. oval or even rectangular, may be suitable in particular circumstances. The maximum internal dimension of the supply tube (i.e. the internal diameter in the case of circular cross sections) is preferably less than two ball diameters. This ensures that no ball can pass another ball within the tube. The maximum internal dimensions of the header tube and downpipe are preferably not significantly greater than one ball diameter. Thus in its golfing application the supply tube is typically of circular cross section with an internal diameter of 60 to 80 mm and the header and downpipe have a circular cross section with an internal diameter of 40 to 50 mm.

The deflector means can be in the form of one or more plates, rods or ramps. In order to permit the onward passage of balls through the supply tube it does not extend across the full cross-section of the supply tube (observed at right angles to the axis of the tube) and thus similarly does not present an undue barrier to any pneumatic flow used to propel the balls forward through the supply tube. With reference to the direction of flow of the balls, a preferred configuration of deflector means follows first a gentle curve away from the wall of the tube, so as not to impose an abrupt change in direction upon the balls, and then continues in a straight line at an angle of inclination to the axis of the supply tube of about 8° to 20°. In most instances an angle of 10° to 15° is preferred. The deflector means typically has a length of about four ball diameters. In cross-section across the tube it is conveniently a ramp having a curved open channel configuration with the curvature being generally similar to that of the ball diameter. Alternatively it can conveniently be formed of two or more plates inclined at an angle to each other across the cross-section of the tube or be formed of two or more rods disposed therein.

The mouth of the header tube preferably has a bell shaped or frusto-conical configuration with its widest diameter facing the direction of flow of the balls and pneumatic stream. This allows for some variation in the position of the balls as they leave the deflector means.

In pneumatic systems employed for the invention it is found that the magnitude of the propelling air pressure is not unduly critical. Relatively small pressures such as 20 to 50 kPa (0.2 to 0.5 bar) are generally sufficient. The balls nevertheless quickly reach velocities as high as 15 to 20 m/sec in the trunk supply tube feeding the individual separator units and so readily cross the gap from the deflector means into the mouth of the header tube.

There is no particular limitation in the material to be employed for the construction of the unit. Conventional plastic materials such as ABS or polypropylene are generally acceptable. In some instances it is preferable to include a hard facing, for example a metal shield, on portions of the unit such as the deflector means and mouth of the header tube which may be subjected to undue wear.

The present invention will now be described in more detail by way of example with reference to the accompanying drawings in which.

Figure 1:
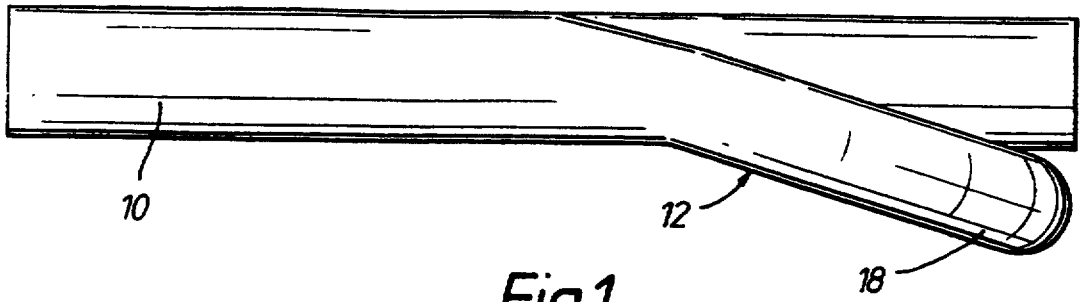
FIG. 1 is a plan view of a first version of ball dispensing unit according to the invention.
Figure 2:
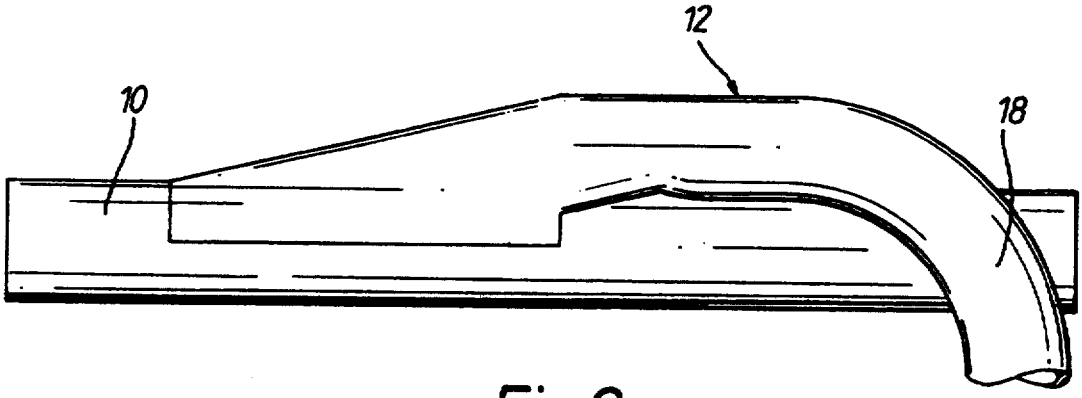
FIG. 2 is a side elevation of the ball dispensing unit shown in FIG. 1.
Figure 3:
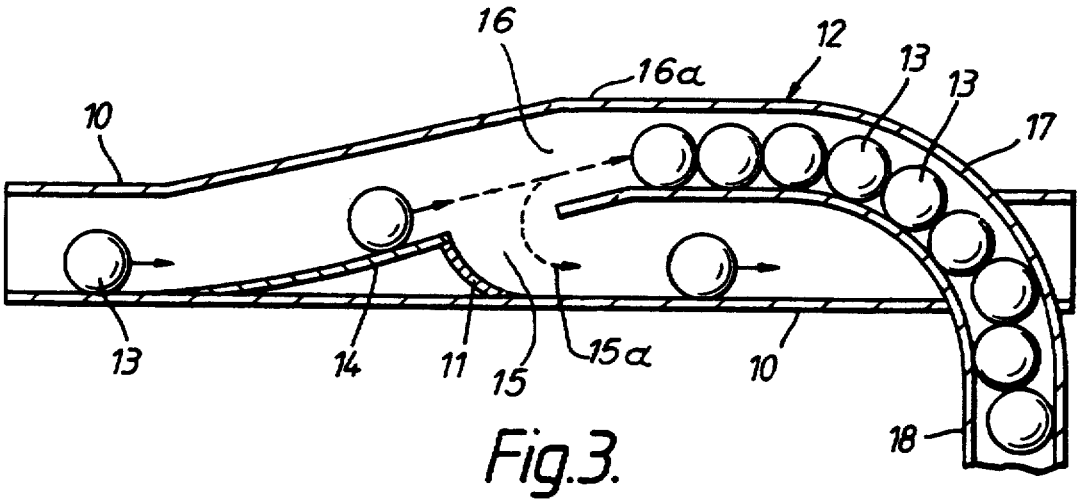
FIG. 3 is a version of FIG. 1 in which portions of the unit are shown in cross-section.

The dispensing unit of FIGS. 1 to 3 comprises a supply tube 10 with a header tube, indicated generally by the number 12, and a ramp 14. The header tube 12 has a mouth 16 formed by a frusto-conical portion 16*a*, a curved central portion 17 and a downpipe 18. An opening 15 exists between the ramp 14 and the mouth 16 and is sufficiently large to permit the passage of balls 13 therethrough. The ramp 14 has a support 11 which also acts as a guide to redirect balls 13 back into the supply tube 10 as shown by arrow 16*a*.

Figure 4:
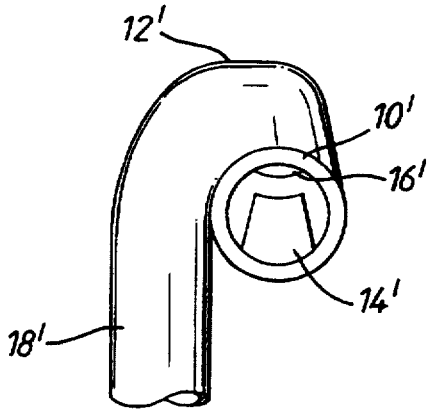
FIG. 4 is an end elevation of a dispensing unit similar to those of FIGS. 1 to 3.

The ramp 14 has a curved , trough-like, cross section with a curvature similar to that of the balls 13 but does not extend across the full internal width of the supply tube 10. The trough-like configuration of the ramp is more clearly shown in FIG. 4, although in this Figure the header tube 12' and the downpipe 18' are located at the opposite side of the supply tube 10' and mouth 16' from the configuration of FIGS. 1 to 3.

In the operating configuration of the unit shown in FIGS. 1 to 3 the supply tube 10 typically forms part of a mains supply tube from an air blower (not shown) and a ball projecting system (not shown) which delivers balls to the unit. The balls 13 to be dispensed enter the mains supply tube from a collection point, are propelled along it by the pneumatic flow from the blower and travel at speed to the supply tube 10, which is disposed substantially horizontally. As each ball reaches the unit it travels up the ramp 14 and is deflected towards the mouth 16 of the header tube 12. The travelling velocity of the ball is sufficient for it to cross the gap that exists between the end of the ramp and the mouth of the header tube 16. The balls 13 travel along the central portion 17 of the header tube 12 and then pass into a downpipe 18.

However, if both the downpipe 18 and the header tube 12 are full with collected balls then the next ball that approaches the mouth 16 of the header tube 12 cannot enter, or cannot fully enter, the header tube 12 but instead collides with and rebounds as indicated by arrow 15*a* from the last ball in the header tube 12 and is re-directed through the opening 15 between the ramp 14 and the mouth 16 of the header tube 12 and hence re-enters the main supply tube 10 to be conveyed to the next dispensing unit in the system. If all the dispensing units are full the non-separated balls can be returned to the initial supply hopper.

Figure 5:
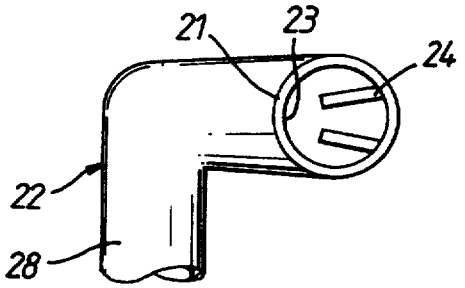
FIG. 5 is an end elevation of another version of dispensing unit according to the invention, viewed from a similar position to that of FIG. 4.
Figure 6:
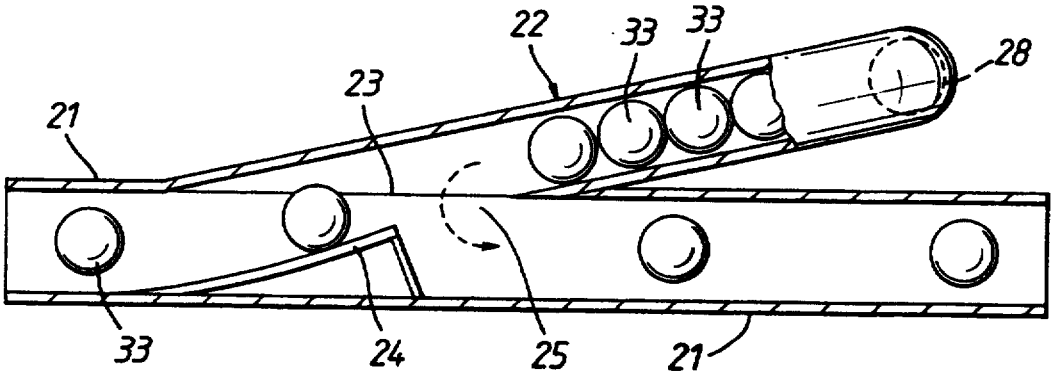
FIG. 6 is a view from above, partially in cross section, of the version of ball dispensing unit shown in FIG. 5.

In the version of dispensing unit shown in FIGS. 5 and 6, the dispensing unit comprises a supply tube 21 with a header tube, indicated generally by the number 22. The upstream end of the header tube 22 leads from the sidewall of the supply tube 21, presenting an elongated side inlet (mouth) 23 to incoming balls 33. The upstream end of the header tube 22 slopes away from the supply tube 21 and its downstream end forms a downpipe 28 extending vertically downwards to a ball-removing point (not illustrated).

Two guide bars 24 extend from the side of the supply tube 21 opposite the inlet 23, and are curved towards the said inlet in order to deflect incoming balls 33 into it. The bars 24 are of a length which stops short of the inlet 23 so as to leave an opening 25 sufficiently large to permit the passage of balls 33 to beyond the inlet 23 when the header tube 22 is full.

The version illustrated in FIGS. 5 and 6 is operated in a generally similar manner to that of FIGS. 1–3. The balls 33 to be separated and dispensed again enter from a horizontally-disposed supply tube 21. As each ball reaches the unit it strikes the guide bars 24 and is deflected into the mouth 23 of the header tube 22, rolls into the header tube 22 and then into its downpipe 28 to the extent permitted by balls 33 already present.

When both the downpipe 28 and the header tube 22 are full with collected balls the next ball that approaches the inlet 23 cannot fully enter the header tube 22 and returns to the supply tube 21 through the opening 25.

What is claimed is:

1. A dispensing unit for balls which comprises a supply tube (10) and a delivery tube, characterised in that the delivery tube includes a header tube (12) with a mouth portion (16) leading away from the supply tube (10), and the supply tube (10) is provided with deflector means (14) which is formed of at least two rods disposed within the supply tube, said deflector means being inclined towards the mouth portion (16) of the header tube (12) but stopping short thereof forming an opening (15) to permit the onward passage of balls through the supply tube, so that balls passing along the supply tube (10) are deflected into the mouth (16) to fill the header tube (12) and when the header tube (12) is full the balls return to and continue to pass through the supply tube (10).

2. A dispensing unit as claimed in claim 1, in which the header tube is a curved tube extending from the mouth portion and externally around the supply tube to a downpipe leading to a dispensing point.

3. A dispensing unit as claimed in claim 2 which the maximum internal dimensions of the header tube and downpipe are not significantly greater than one ball diameter.

4. A dispensing unit as claimed in claim 1, in which the tubes are of circular cross section.

5. A dispensing unit as claimed in claim 1, in which the maximum internal dimension of the supply tube is less than two ball diameters.

6. A dispensing unit as claimed in claim 1, in which the deflector means is a ramp which has a curved open channel configuration, viewed in cross-section across the tube.

7. A dispensing unit as claimed in claim 6, in which the cross-section of the ramp curvature is generally similar to that of the ball diameter.

8. A dispensing unit as claimed in claim 1, in which the deflector means extends only across a part of the width of the supply tube.

9. A dispensing unit as claimed in claim 1, in which, in the direction followed by the balls, the deflector means follows first a gentle curve away from the wall of the tube, so as not to impose an abrupt change in direction upon the balls, and then continues in a straight line at an angle of inclination to the axis of the supply tube of about 8° to 20°.

10. A dispensing unit as claimed in claim 9, in which the angle of inclination of the straight line portion of the deflector means to the axis of the supply tube is 10° to 15°.

11. A dispensing unit as claimed in claim 1, in which the deflector means has a length of about four ball diameters.

12. A dispensing unit as claimed in claim 1, in which the supply tube includes air blower means for supplying a pneumatic stream, the mouth of the header tube has a bell-shaped configuration with its widest dimension facing the direction of flow of the balls and the pneumatic stream.

13. A dispensing unit as claimed in claim 1, which is constructed of a plastic material on which portions which may be subjected to undue wear include a hard facing.

14. A dispensing unit as claimed in claim 13, in which the hard facing is a metal shield.

15. A dispensing unit as claimed in claim 1, in which the supply tube includes air blower means for supplying a pneumatic stream, the mouth of the header tube has a frusto-conical configuration with its widest dimension facing the direction of flow of the balls and the pneumatic stream.

16. A dispensing unit for balls which comprises a supply tube (10) and a delivery tube, the delivery tube includes a header tube (12) with a mouth portion (16) leading away from the supply tube, and the supply tube is provided with deflector means (14) inclined towards the mouth portion of the header tube but stopping short thereof so as to form an opening (15) to the supply tube, so that balls being passed along the supply tube are deflected into the mouth (16) to fill the header tube and when said header tube is full the balls continue to pass through the opening (15) and into the supply tube, the diameter of the supply tube having a maximum dimension which is less than two ball diameters, to ensure that no ball can pass another ball within the supply tube.

17. A dispensing unit as claimed in claim 16, in which the deflector means is formed of at least two plates inclined at an angle to each other across the cross-section of the supply tube.

* * * * *